US006244684B1

(12) United States Patent
Kokai et al.

(10) Patent No.: US 6,244,684 B1
(45) Date of Patent: Jun. 12, 2001

(54) INK JET PRINTER

(75) Inventors: Kuniaki Kokai; Koichi Tanaka, both of Niigata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/271,414

(22) Filed: Mar. 17, 1999

(30) Foreign Application Priority Data

Mar. 17, 1998 (JP) ..... 10-085070

(51) Int. Cl.[7] ..... B41J 2/165
(52) U.S. Cl. ..... 347/30
(58) Field of Search ..... 347/30, 23, 29

(56) References Cited

U.S. PATENT DOCUMENTS

| | | | | |
|---|---|---|---|---|
| 5,386,222 | | 1/1995 | Iwata | 347/89 |
| 5,448,271 | | 9/1995 | Yamaguchi et al. | 347/30 |
| 5,805,180 | * | 9/1998 | Ebisawa et al. | 347/23 |

FOREIGN PATENT DOCUMENTS

| | | | |
|---|---|---|---|
| 0541519 | | 5/1993 | (EP) . |
| 0 865 924 | * | 9/1998 | (EP) . |
| 3-051137 | | 3/1991 | (JP) . |
| 373354 | | 3/1991 | (JP) . |
| 3132357 | | 6/1991 | (JP) . |
| 3272861 | | 12/1991 | (JP) . |
| 5-116339 | | 5/1993 | (JP) . |
| 7117240 | | 5/1995 | (JP) . |
| 9240019 | | 9/1997 | (JP) . |
| 9-277559 | | 10/1997 | (JP) . |
| 1034949 | | 2/1998 | (JP) . |

OTHER PUBLICATIONS

European Search Report (in English) issued Mar. 16, 2000 in a related application. Ref# 3003 Appl# 99105394.3–2304.

Patent Abstracts of Japan, vol. 1998, No. 01, Jan. 30, 1993 & JP 09–240019 A (Ricoh Co Ltd), Sep. 16, 1997, *Abstract*. (A copy of this document is not included as JP 09–240019 was cited previously.).

* cited by examiner

*Primary Examiner*—N. Le
*Assistant Examiner*—Shih-Wen Hsieh
(74) *Attorney, Agent, or Firm*—Ostrolenk, Faber, Gerb & Soffen, LLP

(57) ABSTRACT

An ink jet printer of the present invention includes a recovering device for repeating, at the time of recovery from defective ink ejection, the suction of ink a plurality of times while varying a suction pressure acting on the ink. This successfully reduces the amount of bubbles and reduces the number of times of suction to thereby obviate the wasteful consumption of ink at the time of recovery. A printing method practicable with the ink jet printer and a storage medium storing the printing method are also disclosed.

11 Claims, 3 Drawing Sheets

INK JET PRINTER

BACKGROUND OF THE INVENTION

The present invention relates to an ink jet printer and more particularly to an ink jet printer capable of causing a print head thereof to recover from defective ink ejection, a printing method practicable with the ink jet printer, and a storage medium storing the printing method.

An ink jet printer extensively used today drives a print head thereof in accordance with a signal received from a computer and thereby prints a text or a graphic on a recording medium. Conventional ink jet printers are generally classified into two types. One type of ink jet printer includes a print head portion and a replaceable or removable ink tank storing ink therein and allows, when the ink tank runs out of ink, the ink tank to be replaced alone. The other type of ink jet printer includes a print head and an ink tank constructed integrally with each other and causes, when the ink tank runs out of ink, the print head to be replaced together with the ink tank.

The problem with the printer including the replaceable ink tank is that at the time of replacement of the tank an ink feed section is exposed to the outside. As a result, bubbles and dust are introduced into the ink feed section and stop up an ink passage, making ink ejection defective. In light of this, it has been customary to arrange a filter in the ink passage and to compress or suck the ink with recovering means for thereby discharging the bubbles via the ends of nozzles. The recovering means, however, must repeat suction a number of times for fully discharging the bubbles from the ink passage, resulting in the wasteful consumption of ink.

Technologies relating to the present invention are disclosed in, e.g., Japanese Patent Laid-open Publication Nos. 3-73354, 3-132357, 7-117240, 3-272861, 9-240019, and 10-34949.

SUMMARY OF THE INVENTION

It is therefore an object of the present invention to provide an ink jet printer capable of obviating defective ink ejection without wasting ink and thereby enhancing printing quality, a printing method practicable with the ink jet printer, and a storage medium storing the printing method.

In accordance with the present invention, an ink jet printer includes a nozzle for ejecting ink, an ink passage fluidly communicated to the nozzle, an ink feed section for feeding ink to the ink passage, an ink tank removably mounted on the ink feed section and storing the ink, a print head including the nozzle, ink passage, and ink feed section, and a recovering device for causing the print head to recover from defective ink ejection. The recovering device sucks, at the time of recovery, the ink a plurality of times while varying a suction pressure acting on the ink. The ink feed section and ink passage may be communicated to each other via a filter;

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

To better understand the present invention, brief reference will be made to a conventional ink jet printer of the type generally made up of a head portion and a replaceable ink tank storing ink. In this type of ink jet printer, when the ink tank runs out of ink, it is replaced, but the head portion is continuously used. It has been customary with this type of ink jet printer to arrange a filter in an ink passage for obviating defective ink ejection, as stated earlier. The filter maybe combined with recovering means for forcibly ejecting bubbles from the ends of nozzles by compression or suction, as also stated previously.

Figure 1:
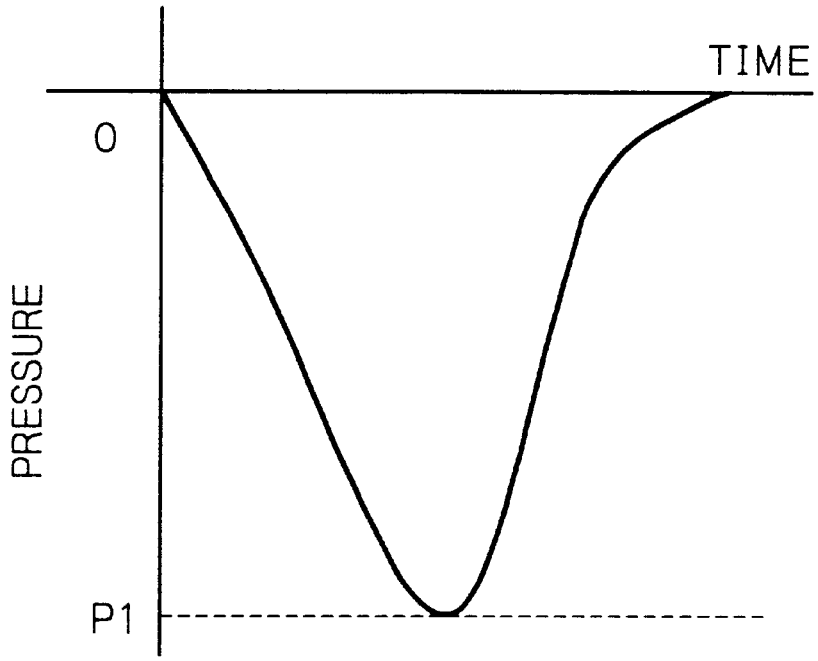
Fig. 1 PRIOR ART
FIG. 1 is a chart representative of a suction sequence executed by recovering means included in a conventional ink jet printer.

FIG. 1 shows a conventional suction sequence particular to the above recovering means. In FIG. 1, the ordinate and abscissa respectively indicate a negative pressure or suction pressure P and time T. As shown, the recovering means sharply increases the suction pressure P to a pressure P1 and then lowers it little by little. This brings about a problem that the sharp increase of the suction pressure causes the ink to flow at a high rate around the filter. As a result, air on the filter is mixed with the ink and appears in the form of bubbles in the ink passage just down stream of the filter. In addition, the ink flowing at the high rate foams in the passage just downstream of the filter and is apt to aggravate the bubble problem. It is therefore necessary to repeat the suction a number of times for removing the bubbles from the ink passage, simply wasting the ink.

Figure 2:
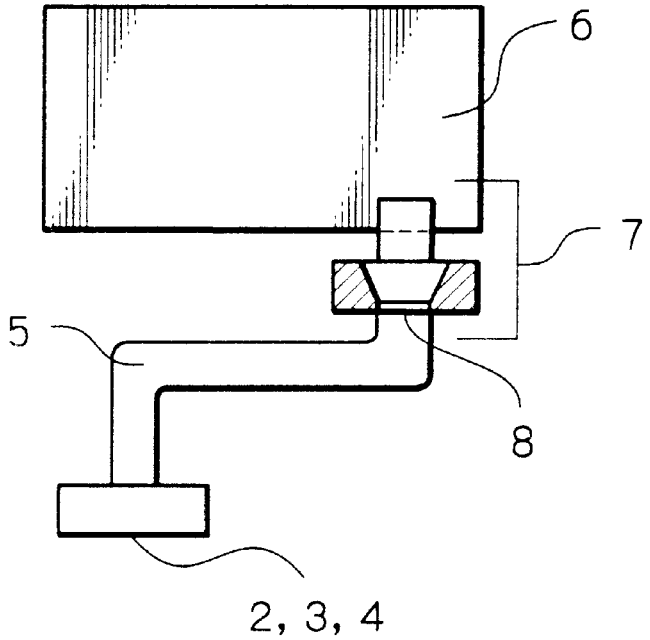
FIG. 2 is a view showing an ink jet printer embodying the present invention.

Referring to FIG. 2, an ink jet printer embodying the present invention, particularly an ink feed section thereof, is shown. Briefly, the illustrative embodiment is characterized in that recovering means performs suction a plurality of times while varying a suction pressure. As shown, a tricolor ink tank 6 is connected to an ink feed section 7 which is, in turn, connected to an ink passage 5 via a mesh-like filter 8. A print head, not shown, is positioned at the end of the ink passage 5 remote from the ink tank 6 and includes a cyan (C) nozzle 2, a magenta (M) nozzle 3 and a yellow (Y) nozzle 4. Ink is fed from the tricolor ink tank 6 to each of the C, M and Y nozzles 2–4 via the ink feed section 7 and ink passage 5.

Figure 3:
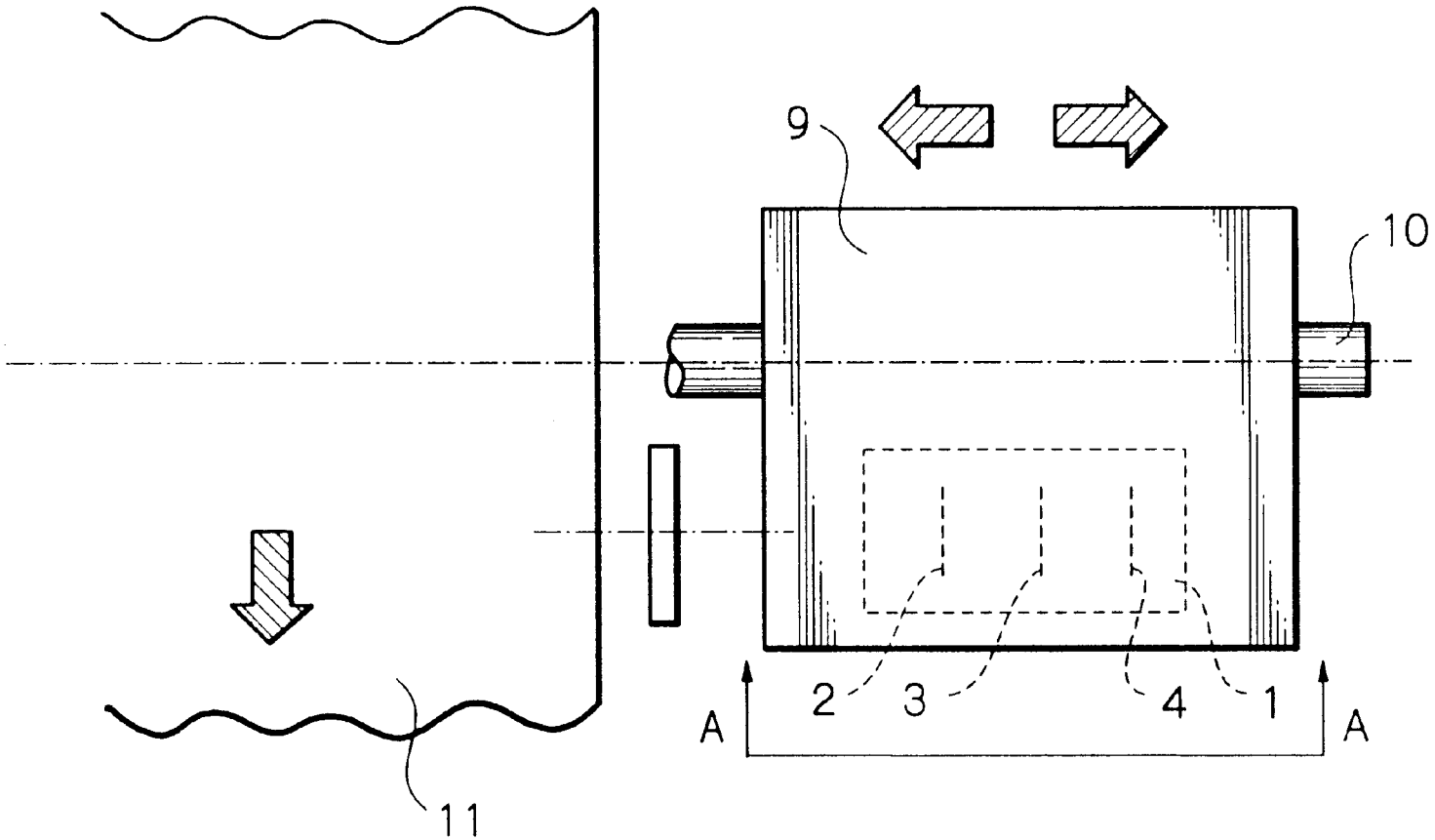
FIG. 3 shows the layout of a print head included in the illustrative embodiment together with arrangements around the head.
Figure 4:
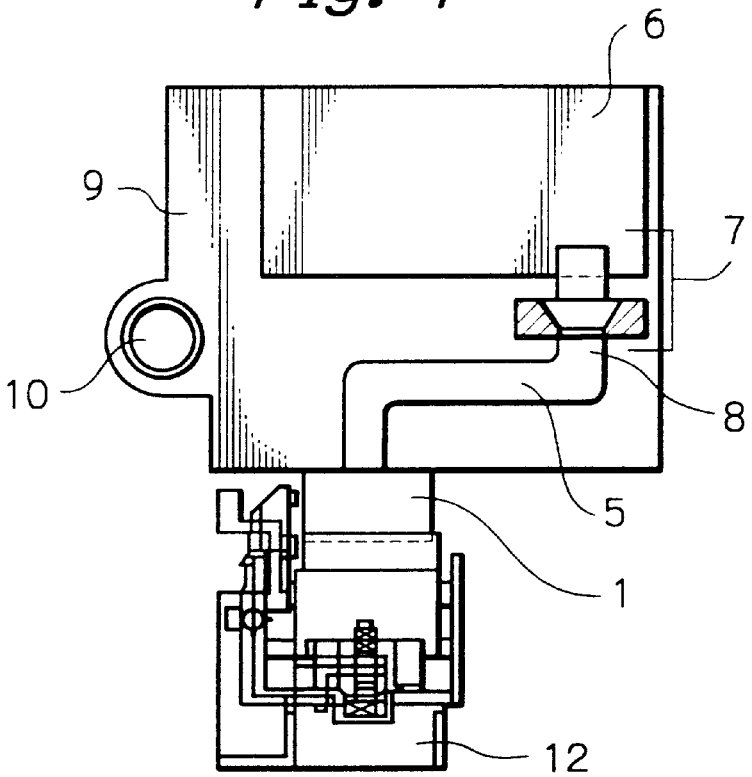
FIG. 4 is a view as seen in a direction A—A of FIG. 3.

As shown in FIGS. 3 and 4, the print head, labeled 1, is mounted on a carrier 9. The carrier 9 is movable on a guide shaft 10 back and forth in the right-and-left direction, as indicated by arrows in FIG. 3. Feed rollers, not shown, convey a recording medium 11 at preselected intervals in a direction indicated by an arrow in FIG. 3. In FIG. 4, the reference numeral 12 designates a recovering section unique to the illustrative embodiment.

Piezoelectric elements, not shown, drive the print head 1. The print head 1 is connected to the tricolor ink tank 6 via the ink feed section 7. The ink tank 6 is also mounted on the carrier 9. The ink feed section 7 and ink passage 5 are fluidly communicated to each other via the filter 8.

The recovering section 12 is constructed to suck ink with, e.g., a piston.

In operation, a motor, not shown, causes the carrier 9 to move along the guide shaft 10 back and forth in the right-and-left direction, as viewed in FIG. 3. At the same time, a feed motor, not shown, drives the feed rollers in order to convey the recording medium 11 in the direction indicated by the arrow in FIG. 3. A personal computer, not shown, sends an signal representative of a desired image to the printer. The C, M and Y nozzles 2–4 of the print head 1 each eject ink of particular color toward the recording medium 11 in accordance with the signal, forming an image on the medium 11.

Assume that the head fails to adequately eject ink due to bubbles introduced therein via the surfaces of the nozzles 2–4, or that the recording medium 11 is smeared by the ink ejected at a position deviated from an expected print position for forming a dot or by the ink dropping from the surfaces of the nozzles 2, 3 and 4. Then, the illustrative embodiment executes a head recovery procedure. As for the head recovery procedure, some different modes are available with the illustrative embodiment, e.g., a mode selected when the printer is used for the first time after shipment, a tank replacement mode selected when the ink tank 6 is replaced due to an ink end condition, a cleaning mode selected when the nozzles 2–4 are stopped up, and a recovery mode selected at the time of power-on.

Figure 5:
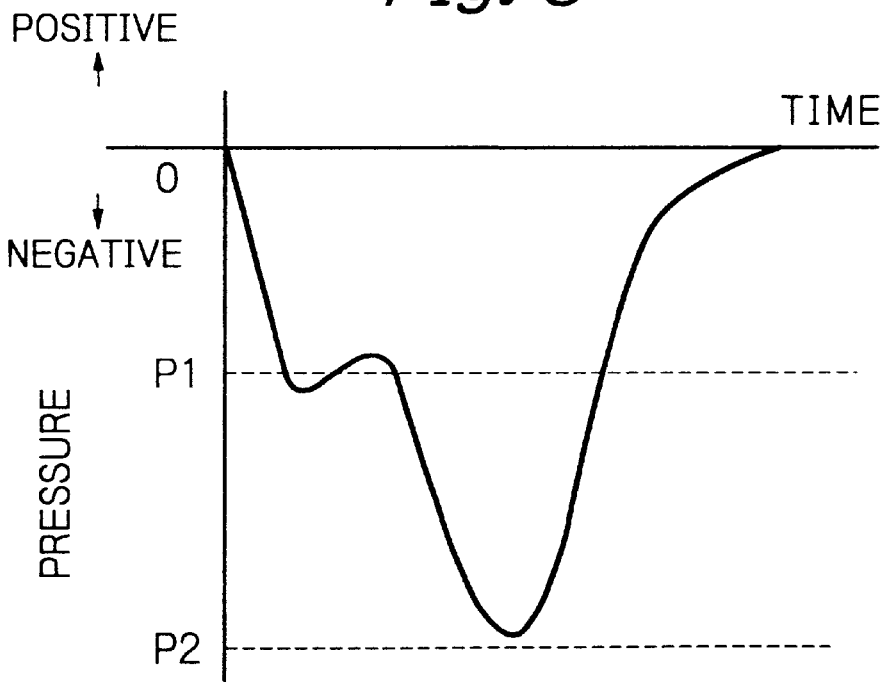
FIG. 5 is a chart demonstrating a specific suction sequence executed by recovering means included in the illustrative embodiment.

Reference will be made to FIG. 5, as well as FIG. 2, for describing a specific suction sequence, which the recovering section 12 executes in the tank replacement mode by way of example. In FIG. 5, the ordinate and abscissa indicate a negative pressure P and time T, respectively. A pressure P1 is the minimum pressure necessary for the ink to flow through the filter 8, but prevents the ink from flowing at a rate too low to interrupt the feed of the ink from the ink tank 6. A pressure P2 allows air dissolved in the ink to form bubbles in the ink passage 5 due to cavitation. In the illustrative embodiment, the pressures P1 and P2 are selected to be −180 mmHg and −380 mmHg, respectively, although they are variable in accordance with the length and diameter of the ink passage 5.

First, the pressure P inside the ink passage 5 is intensified slightly above the pressure P1 (negative pressure). As a result, ink stored in sponge, not shown, disposed in the ink tank 6 migrates through the sponge at a sufficiently low rate and flows into the ink feed section 7. The ink reached the ink feed section 7 flows through the mesh-like filter 8, entraining a thin air layer existing on the filter 8. However, the flow rate of the ink is low enough to suppress foaming at the position just downstream of the filter 8. Consequently, only bubbles ascribable to the air layer are produced in the ink.

Subsequently, the pressure P inside the ink passage 5 is further intensified to a value short of the pressure P2 (negative value) so as to increase the flow rate of the ink in the passage 5. As a result, the bubbles derived from the air layer and appeared just after the ink under the pressure P1 has flown through the filter 8 are discharged from the nozzles 2–4. The ink therefore fills the entire path extending from the ink tank 6 to the ends of the nozzles 2–4.

As stated above, the illustrative embodiment varies the pressure P inside of the ink passage 5 stepwise, i.e., first intensifies the pressure P to the pressure P1 and then further intensifies it to the pressure P2 on the elapse of a preselected period of time. This is successful to reduce defective ink ejection ascribable to bubbles appearing at the filter 3, and therefore to print images in a stable manner.

When the recovering section 12 operates in the cleaning mode or the recovery mode, the ink passage 5 has already been filled with the ink. It follows that the suction pressures to be exerted by the recovering section 12 can be lower in the cleaning mode and recovery mode than in the tank replacement mode, although not shown specifically.

The illustrative embodiment first sucks the ink with a negative pressure low enough to cause the ink to flow in the ink tank 6 at a low rate. This prevents the flow of the ink in the sponge of the ink tank 6 from being interrupted and thereby obviates bubbles otherwise appearing in the ink tank 6.

Although bubbles flown through the filter 8 exist in the ink passage 5 just downstream of the filter 8, bubbles ascribable to foaming of the ink are reduced. After the suction with the low negative pressure, the illustrative embodiment sucks the ink with a high negative pressure and thereby increases the flow rate of the ink in the ink passage 5. As a result, all the bubbles in the ink passage 5 are successfully discharged from the nozzles 2–4 together with the ink.

Because the suction sequence shown and described minimizes the amount of bubbles just downstream of the filter 8, the number of times suction for discharging bubbles can be reduced.

Further, because all the bubbles in the ink passage 5 are driven out via the nozzles 2–4, it is possible to obviate defective ink ejection and therefore to enhance printing quality. In addition, the illustrative embodiment enhances the characteristic and performance of an ink jet printer, a small size, light weight configuration, power saving, high integration, simple circuit and device arrangement, transmission efficiency, security, reliability, easy manipulation, productivity, easy maintenance, and resource recycling.

While the print head 1 of the illustrative embodiment is driven by piezoelectric elements, it may alternatively be driven by electrothermic transducers. Also, the piston type suction system applied to the recovering section 12 may be replaced with, e.g., a roller pump type suction system. In addition, there can be provided a storage medium storing a program describing the ink jet printing method of the present invention.

In summary, in accordance with the present invention, an ink jet printer includes recovering means repeating, at the time of recovery from defective ink ejection, the suction of ink a plurality of times while varying a suction pressure. This successfully reduces the amount of bubbles and reduces the number of times of suction to thereby obviate the wasteful consumption of ink at the time of recovery.

Various modifications will become possible for those skilled in the art after receiving the teachings of the present disclosure without departing from the scope thereof.

What is claimed is:

1. An ink jet printer comprising:

a nozzle for ejecting ink;

an ink passage fluidly communicating with said nozzle;

an ink feed section for feeding ink to said ink passage;

an ink tank removably mounted on said ink feed section and storing the ink;

a print head including said nozzle, said ink passage, and said ink feed section; and recovering means for causing said print head to recover from defective ink ejection;

said recovering means sucking, at a time of recovery, the ink a plurality of times while varying a suction pressure acting on the ink;

wherein said recovering means repeatedly varies the suction pressure a plurality of times stepwise in an order of a low negative pressure to a high negative pressure without interruption in pressure.

2. An ink jet printer as claimed in claim 1, wherein the suction pressure includes a high suction pressure not causing cavitation to occur in said ink passage.

3. An ink jet printer as claimed in claim 1, wherein said recovering means generates the suction pressure with a piston.

4. An ink jet printer as claimed in claim 1, wherein said recovering means generates the suction pressure with a roller pump.

5. An ink jet printer comprising:

a nozzle for ejecting ink;

an ink passage fluidly communicating with said nozzle;

an ink feed section for feeding ink to said ink passage;

an ink tank removably mounted on said ink feed section and storing the ink;

a print head including said nozzle, said ink passage, and said ink feed section; and recovering means for causing said print head to recover from defective ink ejection;

said ink feed section and said ink passage communicating to each other via a filter;

said recovering means sucking, at a time of recovery, the ink a plurality of times while varying a suction pressure acting on the ink;

wherein said recovering means repeatedly varies the suction pressure a plurality of times stepwise in an order of a low negative pressure to a high negative pressure without interruption in pressure.

6. An ink jet printer as claimed in claim 5, wherein the suction pressure includes a low negative pressure which is a minimum pressure for causing the ink to flow through said filter.

7. An ink jet printer as claimed in claim 5, wherein the suction pressure includes a high suction pressure not causing cavitation to occur in said ink passage.

8. An ink jet printer as claimed in claim 5, wherein said recovering means generates the suction pressure with a piston.

9. An ink jet printer as claimed in claim 5, wherein said recovering means generates the suction pressure with a roller pump.

10. A printer method practicable with an inkjet printer including a nozzle for ejecting ink, an ink passage fluidly communication with said nozzle, an ink feed section for feeding ink to said ink passage, an ink tank removably mounted on said ink feed section and storing the ink, a print head including said nozzle, said ink passage, and said ink feed section and recovering means for causing said print head to recover from defective ink ejection, said method comprising the step of sucking, at a time of recovery, the ink a plurality of times while repeatedly varying a suction pressure acting on the ink, wherein the suction pressure varies stepwise in an order of a low negative pressure to a high negative pressure without interruption in pressure.

11. A printing method as claimed in claim 10, wherein said method uses a storage medium storing a program for practicing said printing method.

* * * * *